United States Patent [19]

Hanna

[11] 4,179,180

[45] Dec. 18, 1979

[54] SAFETY ELECTRICAL RECEPTACLE AND PLUG THEREFOR

[76] Inventor: Bobby W. Hanna, Box 174, Shiloh, Ga. 31826

[21] Appl. No.: 905,723

[22] Filed: May 15, 1978

[51] Int. Cl.[2] ..... H01R 33/46

[52] U.S. Cl. ..... 339/189 R; 339/14 P

[58] Field of Search ..... 339/14 P, 39, 41, 75 P, 339/75 T, 88 R, 88 C, 188 R, 189 R, 189 L, 188 C

[56] References Cited

U.S. PATENT DOCUMENTS

| | | | |
|---|---|---|---|
| 1,294,444 | 2/1918 | Goetzelman | 339/189 R |
| 2,312,017 | 2/1943 | Ackerman | 339/189 R |
| 3,971,619 | 7/1976 | Rohrssen | 339/189 R |

FOREIGN PATENT DOCUMENTS

| | | | |
|---|---|---|---|
| 171330 | 5/1960 | Sweden | 339/188 C |

*Primary Examiner*—Neil Abrams

*Attorney, Agent, or Firm*—Harold L. Marquis

[57] ABSTRACT

An interlocking electrical connector comprising a receptacle with a pair of arcuate slots with a U-shape and having a prong-receiving opening at one end and electrical contacts at the other end and a plug-in connector with a pair of corresponding U-shaped electrical prongs.

4 Claims, 5 Drawing Figures

SAFETY ELECTRICAL RECEPTACLE AND PLUG THEREFOR

SUMMARY OF THE INVENTION

It is the primary purpose of this invention to develop an electrical receptacle and plug-in connector that virtually eliminates the risk of anyone, especially children, receiving an electrical shock from the receptacle and plug-in connector while connected or during connection. Applicant has developed a safety electrical receptacle and a plug-in connector which will not make electrical contact until the conducting prongs of the plug are fully inserted into the receptacle and the plug is twisted into position.

DETAILED DESCRIPTION OF THE DRAWINGS

Figure 1:
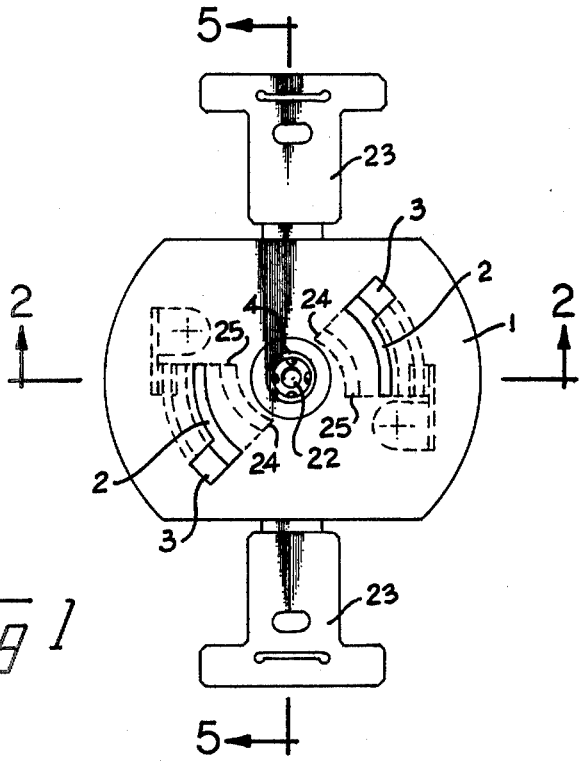
FIG. 1 is a front elevation of the improved safety electrical receptacle.
Figure 5:
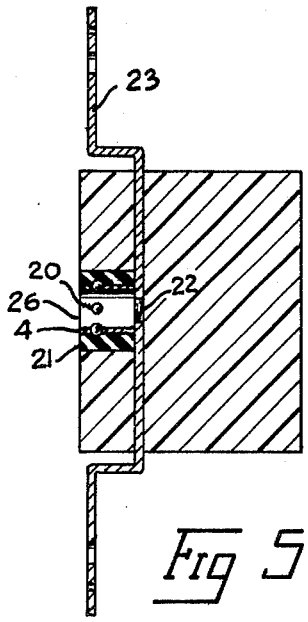
FIG. 5 is an end sectional view of the safety receptacle on the line 5—5 of FIG. 1.
Figure 2:
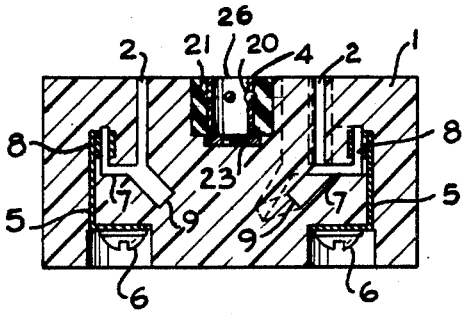
FIG. 2 is a side sectional view of the safety receptacle on the line 2—2 of FIG. 1.
Figure 4:
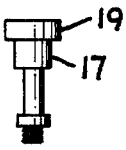
FIG. 4 is a side view of the bolt for holding a cover plate in position on the safety receptacle.
Figure 3:
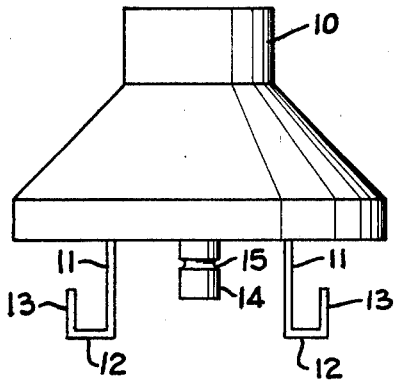
FIG. 3 is a side view of the plug-in connector.

Referring to the drawings, 1 designates the body of the safety electrical receptacle which is constructed of an insulating material. The front of the receptacle has two narrow arcuate slots 2 into the interior of the receptacle. Each slot is arcuate along its entire inside edge and is arcuate for most of its outer edge and is enlarged to provide a prong receiving offset opening 3. The offset openings are located at opposite ends of each slot 2. Each slot 2 constitutes a segment of a circle, the center of which is the circular aperture 26. The receptacle has two electrical contacts 5, which are attached to an electrical power source by screws 6. Each arcuate slot 2 extends into the interior of the receptacle and connects with an outwardly extending channel 7, which in turn connects with a front extending channel 8. Both the outwardly extending channel 7 and front extending channel 8 are connected with the slot 2 throughout its length and also connect with the offset opening 3. The front extending channel 8 does not extend all of the way to the front of the receptacle. Each slot 2 also connects with an inwardly extending channel 9 that extends downwardly so that an obtuse angle is formed at its interconnection with the slot 2. The inwardly extending channel 9 may be constructed so that it has a greater depth in relation to the front of the receptacle at point 24 than at point 25. This construction will help direct any foreign object inserted into the slot 2 away from the electrical contacts 5. This construction is especially helpful when the receptacle is installed in the floor. In the event a child should insert a metal wire or pin into the slot 2, the wire or pin would normally enter the inwardly extending channel 9 rather than the outwardly extending channel 7. Thus, the wire or pin would avoid contact with the electrical contact 5, preventing an electrical shock. The receptacle is mounted to the wall or floor by mounting bracket 23.

The plug-in connector consists of a body 10, which may be conical in shape, and is of conventional construction. The plug-in connector has two conductor prongs 11, which are connected by conventional means to an electrical cord (not shown). Each prong is formed with an outward extension 12 at its end from which an upward extension 13 extends so that the prong is of a U shaped configuration corresponding to the configuration of the slot 2 and channels 7 and 8 of the receptacle. The plug-in connector has a circular guide pin 14. Outward extension 12 projects in the opposite direction from the outward extension of the other prong.

The plug-in connector 10 is connected with the receptacle by aligning each prong 11 with the respective offset opening 3 and inserting the prong into the opening. The guide pin 14 enters the circular aperture 26 and insures the proper alignment of the plug-in connector 10 and receptacle 1. Once the prongs 11 are fully inserted into the offset openings 3, the plug is twisted (in this case in a clock-wise direction) until each upward extension 13 is in contact with the respective electrical contact 5, thus completing the electrical circuit. In this twisting process, the outward extension 12 travels through the outwardly extending channel 7 of the receptacle. This channel serves to lock the plug to the receptacle. The plug-in connector 10 can only be removed by twisting (in this case counterclockwise) until each prong 11 is aligned with the respective offset opening 3 and pulling the plug-in connector away from the receptacle. The guide pin 14 is constructed of conductive material which is connected by a ground wire to the device using the electrical current. The guide pin 14 contacts mounting bracket 23, which when constructed of conductive material serves as an electrical ground. A circular sleeve 4 of metallic construction is preferably interposed between the aperture 26 and the body 1 of the receptacle. This sleeve 4 increases the durability of the aperture 26. The sleeve 4 can be anchored in the body 1 of the receptacle by a weld to the mounting bracket 23. The sleeve 4 also insures that electrical contact is made between the pin 14 and the mounting bracket 23 so that the electrical device is adequately grounded. The guide pin 14 can be provided with a circular groove 15 which cooperates with ball bearings 20 projecting through an opening in the wall of the sleeve 4 to help retain the plug-in connector 10 in the locked position. The ball bearings 20 are held in position by a bushing 21, preferably of neoprene construction, so that a portion of each bearing projects into the aperture 26. The ball bearings 20 facilitate the turning of the plug-in connector during connection and disconnection. Alternatively, the ball bearings could be held in position by a spring. The groove 15 and ball bearings 20 serve to more precisely align the plug-in connector 10 with the receptacle 1, and to help align the outward extension 12 of the prong 11 with the outward channel 7 so the plug can be turned into locked position. The guide pin 14 prevents excessive wear of the prongs 11, 12 and 13 and slot 2 and channels 7 and 8.

The mounting bracket 23 may be provided with an aperture 22 with internal threads to receive a bolt 19, which can be used to attach a cover plate (not shown) to the receptacle when not in use. The cover plate has a central aperture through which the shoulder 17 of the bolt 19 extends. The cover plate is an additional safety precaution for protection of small children when the receptacle is not in use.

The slots 2 and channels 7 and 8 in the receptacle greatly reduce the possibility of a child inserting a wire or pin into a slot and contacting an electrical contact.

The wire or pin would have to navigate two turns in order to make contact with an electrical contact 5. An additional safeguard is provided by the inwardly projecting channels 9 into which the wire or pin would tend to go as the turn required is less acute. The electrical contacts 5 are preferably located adjacent to channel 8 so that the contacts are in a remote location in reference to slot 2 as an additional safety precaution. However, the electrical contacts 5 could be located adjacent to channel 7 or adjacent to both channels 7 and 8 if desired.

Electrical contact is not made until the prongs 11 are fully inserted into the offset openings 3 and twisted. Thus, contact is not made when the portion of prong 11 nearest its plug-in connector 10 is not fully extended into the respective slot 2. Thus, there is no space between the front of its receptacle 1 and the plug-in connector 10 for a child to insert his fingers or an object when electrical contact is made between the plug and receptacle. The ball bearings 20 are designed to correspond with circular groove 15 on the guide pin 14 to hold the prongs in proper position so they are in contact with the respective electrical contacts 5.

Thus, an electrical receptacle and plug-in connector is provided that greatly reduces the possibility of an accidental electrical shock. In addition, when the plug-in connector is in the locked position, it is protected against disengagement by pulling the cord attached to the plug-in connector. The plug-in connector can be easily separated by turning and pulling movements. The receptacle can be provided with two or more pairs of slots 2 so that more than one plug-in connector can be used simultaneously.

What I claim is:

1. The interlocking electrical connector comprising:

(a) a base of electrical insulation material, said base having a front and back and intervening side walls, said base having at least one pair of arcuate slots in spaced relationship in the front of the base, each slot extending into the interior of the base in an interior extending segment and turning outwardly towards a side wall of the base to form an outwardly extending segment of the slot and then turning towards the front of the base to form a front extending segment, with an electrical contact lying adjacent to an end of the front extending segment of each slot, with the interior extending segment of each slot connected to a channel that extends further into the interior of the base in a direction to avoid being adjacent the electrical contacts at any point, with the opposite end of the slot connecting with an enlarged opening in the front of the base, and (b) a plug-in connector carrying spaced electrical contacts, with each contact having a shape corresponding to the shape of the slot in the base, with the contacts adapted to enter the enlarged openings in the front of the base and to be rotated into interlocking position with the electrical contacts in the base.

2. The interlocking electrical connector comprising:

(a) a base of electrical insulation material, said base having a front and back and intervening side walls, said base having at least one pair of arcuate slots in spaced relationship in the front of the base, each slot extending into the interior of the base in an interior extending segment and turning outwardly towards a side wall of the base to form an outwardly extending segment of the slot and then turning towards the front of the base to form a front extending segment, with an electrical contact lying adjacent one end of each slot, with the opposite end of the slot connecting with an enlarged opening in the front of the base, and (b) a plug-in connector carrying spaced electrical contacts, with each contact having a shape corresponding to the shape of the slot in the base, with the contacts adapted to enter the enlarged openings in the front of the base and to be rotated into interlocking position with the electrical contacts in the base, with a guide pin adapted to enter an aperture located between the arcuate slots in the front of the base, with means located in the aperture for retaining the pin in proper axial position in the aperture so that the electrical contacts of the plug-in connector are held in contact with the corresponding electrical contacts in the base when the plug and connector are in an interlocking position.

3. The interlocking electrical connector of claim 2 in which each electrical contact in the base is only adjacent to an end of the front extending segment of the slot.

4. The interlocking electrical connector of claim 2 in which the base is provided with an electrical grounding means which contacts the guide pin when it is inserted into the aperture of the base.

* * * * *